United States Patent [19]

Carpenter

[11] 4,151,618

[45] May 1, 1979

[54] WATER SHEET

[76] Inventor: Arvil W. Carpenter, 111 Ridgewood Cir., Greenwood, S.C. 29646

[21] Appl. No.: 839,762

[22] Filed: Oct. 6, 1977

[51] Int. Cl.[2] ..... A47G 9/00; A47C 21/04

[52] U.S. Cl. ..... 5/284; 5/419; 5/421; 5/484; 4/152

[58] Field of Search ..... 5/186 R, 187, 317, 334, 5/344, 345 R, 370, 284, 347; 297/180, 453; 239/279, 289; 4/152

[56] References Cited

U.S. PATENT DOCUMENTS

| | | | |
|---|---|---|---|
| 2,127,710 | 8/1938 | Baker | 5/186 |
| 3,323,151 | 6/1967 | Newman | 5/344 |
| 3,625,434 | 12/1971 | Kitover | 297/180 |
| 3,689,947 | 9/1972 | Wolf | 5/344 |
| 3,997,927 | 1/1976 | Culligan | 5/317 R |

FOREIGN PATENT DOCUMENTS

| | | | |
|---|---|---|---|
| 1209228 | 2/1960 | France | 5/344 |

*Primary Examiner*—Casmir A. Nunberg
*Attorney, Agent, or Firm*—Luke J. Wilburn, Jr.; Wellington M. Manning, Jr.

[57] ABSTRACT

A device for cooling the human body in seated or reclining position comprising a water-impervious flexible base sheet of sufficient length and width to contain the human body thereon, a head portion of said sheet containing pillow means for cushioning the head of the body, flexible conduit means attached to and extending along edge portions of said base sheet for directing a plurality of streams of water across the surface of said sheet to form a layer of water on the sheet surface for cooling a human body residing on the sheet, and one or more openings through the base sheet to permit discharge of excess water from the surface of the sheet.

3 Claims, 4 Drawing Figures

WATER SHEET

This invention is directed to a recreational device, and, more particularly, to a flexible sheet construction which is employed to cool the human body during sun bathing, lounging, and the like.

The sheet construction of the present invention may be placed for use on a lawn chair, chaise lounge, lounging pad, mattress, or like structures, which are employed to support the body in seated or reclining position during sun bathing. The sheet construction is utilized to provide a cooling layer of water beneath the body during sun bathing, and to provide an additional sunlight reflective surface to facilitate tanning of the body.

The water sheet device of the present invention is comprised of a flexible, waterproof material, such as plastic or suitably treated textile fabric, of sufficient dimensional size to receive the body in reclined position thereon. The head portion of the sheet is provided with suitable pillow means to cushion the head of the sun bather, and the edge portions of the sheet, as well as the portion of the sheet at the lower edge of the pillow means, are provided with flexible tubular conduit means having a row of small openings facing inwardly of the edges of the sheet to direct streams of water across the surface of the sheet on which the body resides.

The main body of the sheet is further provided with water discharge openings therethrough to permit removal of excess water on the surface of the sheet as it is supplied through the conduit means, thereby maintaining a layer of cool water beneath the body of the sun bather for improved comfort.

The invention may be better understood by reference to the accompanying drawings, in which.

Figure 1:
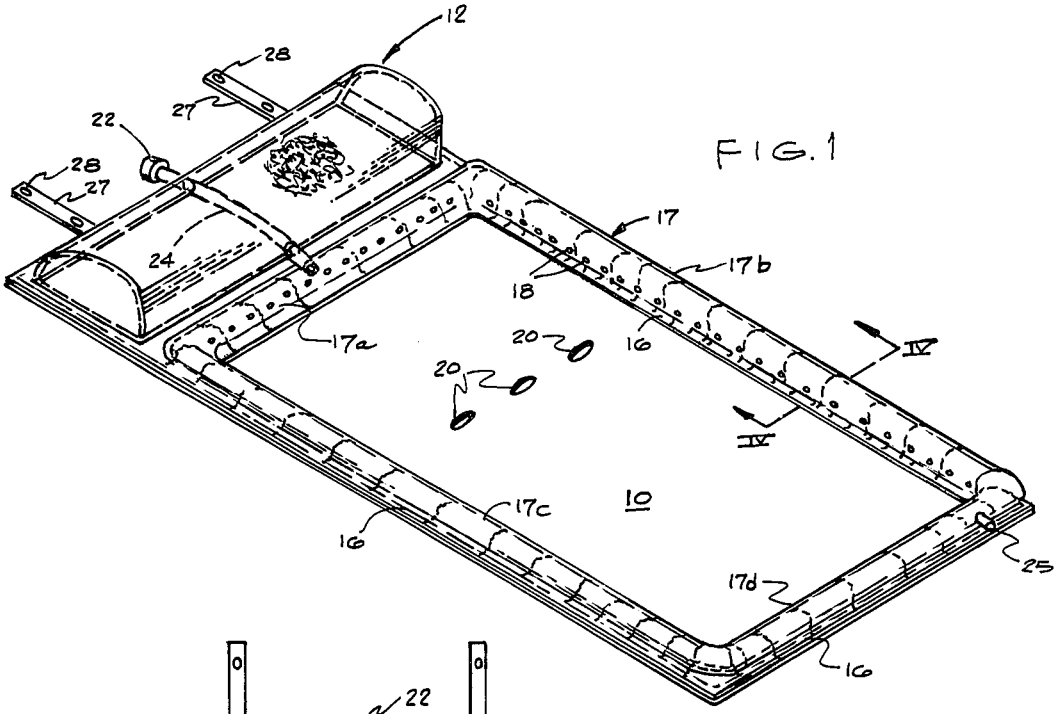
FIG. 1 is a perspective view of a preferred form of embodiment of water sheet construction of the present invention, with certain portions shown in phantom lines to facilitate illustration of the construction of the sheet.
Figure 2:
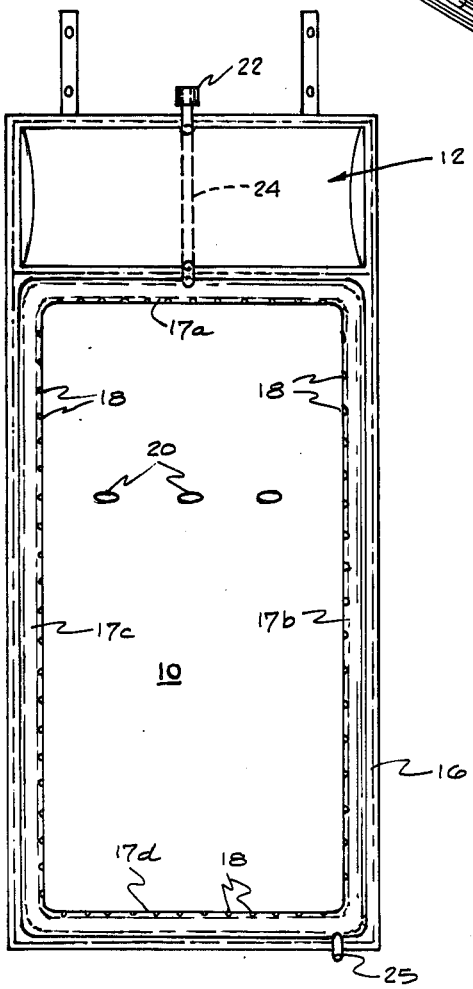
FIG. 2 is a top plan view of the water sheet of FIG. 1.

Referring more particularly to the drawings, FIG. 1 shows a preferred embodiment of the water sheet construction of the present invention which includes a water-impervious base sheet 10 of generally rectangular configuration and of a size to contain the human body thereon in a reclined or semi-reclined position. The head portion of the sheet is provided with a waterproof pillow 12 for cushioning the head of the body during use.

The pillow of the water sheet may be conveniently formed of a soft, cushioning material, such as kapok, foam rubber, plastic foam, or the like which may be enclosed in a waterproof cover or compartment, and suitably attached to the base sheet 10, as by snaps, heat sealing, or sewing.

Figure 4:
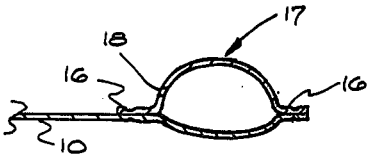
FIG. 4 is a partial sectional view, taken along line IV—IV of FIG. 1.

Extending along the side and bottom edges of base sheet 10 and across the sheet at the bottom edge of the pillow 12 are conduit means, shown as narrow, flexible, water-impervious strips of material which are sealed along their side edges 16 to the rectangular base sheet to form a continuous flexible distributor tube 17 (FIGS. 1 and 4) for passage of water around the lower perimeter of the base sheet. Located along the length of the distributor tube, in the strips of material, are a plurality of small openings 18 which face inwardly of the edges of the base sheet 10 to direct corresponding plural streams of water across the surface of the sheet. The main body of base sheet 10 is provided with one or more openings 20 therethrough to discharge excess water from the upper surface of the sheet on which the sun bather lies, thereby maintaining a relatively shallow layer of water on the surface of the sheet to effectively cool the body of the bather.

Water from an external source, such as a water tap, may be supplied to the water sheet by a flexible garden hose 21 (FIG. 3) which is connected to a water inlet fitting 22 located at the top of the base sheet 10 and pillow 12. Fitting 22 communicates, by way of a short flexible tube 24 extending downwardly from the top edge of the base sheet through the pillow, with the mid-portion of flexible distributor tube portion 17*a* extending across the lower edge of the pillow. Thus by connecting the inlet fitting 22 to a water supply hose, a continuous flow of water may be directed along the pillow distributor tube portion 17*a* and side edge distributor tube portions 17*b*, 17*c*, 17*d* which communicate therewith to direct water across the surface of the base sheet.

Although the water sheet device, as shown, is provided with a lower edge distributor tube portion 17*d*, such may be omitted from the lower edge of the base sheet 10, if desired.

As seen, a safety plug outlet 25 is provided at a suitable location in the distributor tube 17 to avoid damage to the sheet construction in the event excess water pressure builds up in the conduit means of the sheet.

The water sheet device of the present invention may be conveniently and economically manufactured from two sheets of flexible water-impervious, plastic, with the pillow compartment and tubular conduits being formed by heat sealing the edges of the upper plastic sheet to the base sheet.

Figure 3:
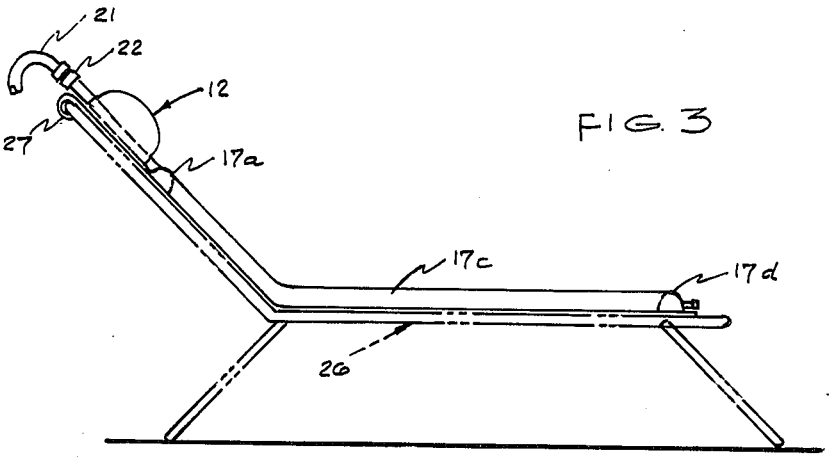
FIG. 3 is a side elevation view of the sheet construction as it typically may be employed on a reclining lounge chair of the outdoor type.

As best seen in FIG. 3, the water sheet may be utilized by placing it on a lawn chair 26. The head portion of the sheet is provided with suitable straps 27 and snap fasteners 28 to attach the top of the sheet to the head of the chair, as shown. The water inlet fitting 22 of the sheet is attached by flexible hose 21 to a water supply source and the flow of water regulated to provide for slow distribution of water over the upper surface of the sheet, with excess water draining from beneath the seat portion of the sheet and chair through the outlet openings 20 in the sheet.

It can be understood that modifications may be made in the specifically described construction of the water sheet without departing from the scope of the present invention. For example, the safety plug outlet 25 and the water inlet fitting 22 may be located at other positions along the flexible distributor tube 17, depending upon the preferred disposition of the sheet during use. The water sheet further may be provided with additional fastening means for attachment to a support cushion, air mattress, or the like, if it is desired to utilize the sheet with other than a chair or chaise lounge type support.

That which is claimed is:

1. A device for cooling the human body in seated or reclining position comprising a water impervious, flexible base sheet of generally rectangular dimensional configuration and of sufficient length and width to contain the human body thereon; a head portion of said sheet containing pillow means for cushioning the head of the body, said pillow means comprising a flexible, water-impervious material overlying the head portion of said sheet and attached by its side edges thereto to form a compartment, and cushioning means in said compartment for supporting the head of a human body; flexible conduit means attached to and extending along edge portions of said base sheet for directing a plurality of streams of water across the surface of said sheet to form a layer of water on the sheet surface for cooling a human body residing on the sheet, said conduit means comprising a flexible water impervious strip of material sealingly attached at its side edges to edge portions of the base sheet and forming with said base sheet edge portions tubular means for directing water about a major portion of the periphery of the base sheet, and a plurality of openings in said water impervious flexible strip of material facing inwardly of edge portions of the base sheet to direct water in said plurality of streams across the surface of said sheet, said flexible conduit means further including flexible tubular means extending transversely across said base sheet along the lower edge portion of said pillow means and having a plurality of openings therein for directing streams of water across the surface of the base sheet; means for introducing water into said flexible conduit means to supply water through said plurality for openings therein; and one or more openings through the base sheet to permit discharge of excess water from the surface of the sheet.

2. A device as defined in claim 1 wherein said means for introducing water into said conduit means comprises flexible tubular means extending upwardly from said transversely extending tubular means and through said pillow means to the top edge portion of said base sheet, and means for connecting said upwardly extending flexible tubular means to a source of water supply.

3. A device as defined in claim 2 wherein said tubular means extending along the lower edge portion of said pillow means communicates with said base sheet edge portion tubular means for supplying water thereto.

* * * * *